US007808386B1

(12) United States Patent
Sayegh et al.

(10) Patent No.: US 7,808,386 B1
(45) Date of Patent: Oct. 5, 2010

(54) THEFT DETERRENT TAG WITH RESILIENT ATTACHMENT

(76) Inventors: Adel O. Sayegh, 5143 Paddock Pl., Rancho Cucamonga, CA (US) 97137; Zhaolian Wu, 1418 Moganshan Road, Hangzhou (CN) 310015

( * ) Notice: Subject to any disclaimer, the term of this patent is extended or adjusted under 35 U.S.C. 154(b) by 366 days.

(21) Appl. No.: 11/776,841

(22) Filed: Jul. 12, 2007

(51) Int. Cl.
*G08B 13/14* (2006.01)

(52) U.S. Cl. ..... 340/572.1; 340/572.8; 235/385

(58) Field of Classification Search ... 340/572.1–572.8; 235/375, 385
See application file for complete search history.

(56) References Cited

U.S. PATENT DOCUMENTS

| | | | | |
|---|---|---|---|---|
| 3,974,581 | A | 8/1976 | Martens et al. | |
| 3,995,900 | A | 12/1976 | Humble et al. | |
| 4,038,726 | A * | 8/1977 | Takabayashi | 24/198 |
| 4,212,303 | A * | 7/1980 | Nolan | 606/120 |
| 4,380,097 | A | 4/1983 | Keifer | |
| 4,483,049 | A | 11/1984 | Gustavsson et al. | |
| 4,649,397 | A * | 3/1987 | Heaton et al. | 340/572.9 |
| 4,670,950 | A | 6/1987 | Wisecup et al. | |
| 5,068,641 | A | 11/1991 | Hogen Esch | |
| 5,577,395 | A | 11/1996 | Kuykendall | |
| 6,102,200 | A | 8/2000 | Dressen et al. | |
| 6,326,890 | B1 | 12/2001 | Costa | |
| D460,012 | S | 7/2002 | Proulx et al. | |
| D466,426 | S | 12/2002 | Proulx et al. | |
| D468,223 | S | 1/2003 | Huehner | |
| D477,240 | S | 7/2003 | Huehner | |
| 6,754,939 | B2 * | 6/2004 | Belden et al. | 24/704.1 |
| 6,848,285 | B2 | 2/2005 | Stroh | |
| 7,062,823 | B2 | 6/2006 | Copen et al. | |
| 7,249,401 | B2 * | 7/2007 | Copen et al. | 24/704.1 |
| 7,526,931 | B2 * | 5/2009 | Burdett et al. | 70/57.1 |
| 2004/0172988 | A1 | 9/2004 | Gorst | |
| 2006/0021394 | A1 | 2/2006 | Belden | |
| 2006/0070410 | A1 | 4/2006 | Fuss | |

* cited by examiner

*Primary Examiner*—Eric M Blount
(74) *Attorney, Agent, or Firm*—Milord A. Keshishian

(57) ABSTRACT

An article surveillance tag that has a barrier that is resiliently maintained between a first and second portion of the tag and is adapted to adjustably maintain an article to be monitored there between.

20 Claims, 5 Drawing Sheets

THEFT DETERRENT TAG WITH RESILIENT ATTACHMENT

CROSS-REFERENCE TO RELATED APPLICATIONS

The contents of this application are related to U.S. design patent application titled "ELECTRONIC ARTICLE SURVEILLANCE TAG," having Ser. No. 29/248,998, filed on Sep. 14, 2006, and U.S. utility patent application titled "THEFT DETERRENT TAG," having Ser. No. 11/255,428, filed on Oct. 19, 2005, which in turn claims priority to U.S. design patent applications titled "ELECTRONIC ARTICLE SURVEILLANCE TAG" and "ELECTRONIC ARTICLE SURVEILLANCE UNIT" having Ser. Nos. 29/240,195 and 29/240,196, respectively, filed on Oct. 11, 2005, the contents of which are incorporated herein by reference.

TECHNOLOGICAL FIELD

The device described and claimed herein relates to theft deterrent security tags in general, and in particular to a security tag that is attachable to items to be monitored which items are engaged by a resilient mechanism.

BACKGROUND OF THE INVENTION

Various types of electronic article surveillance (EAS) systems are known having the common feature of employing a marker or tag which is affixed to an article to be protected against theft from a controlled area, such as merchandise in a store. When a legitimate purchase of the article is made, the marker can either be removed from the article, or converted from an activated state to a deactivated state. Such systems employ a detection arrangement, commonly placed at all exits of a store, and if an activated marker passes through the detection system, it is detected by the detection system and an alarm is triggered.

Such electronic detection arrangements, as used in the present invention, are well known in the art and preferred embodiment is discussed in my U.S. Pat. No. 7,084,766, titled "Article Surveillance Tag Having a Metal Clip" which is incorporated herein by reference.

Current inventions in this field do not address the need for an EAS tag that is difficult to defeat and easy to use. In addition, the existing inventions fail to provide a theft deterrent tag assembly that can be securely engaged to articles which either should not be penetrated by a pin to prevent damage, because of their delicate nature, or are made of impenetrable material. Therefore, there remains a long standing and continuing need for an advance in the art of EAS and theft deterrent tags that makes the tags more difficult to defeat, simpler in both design and use, more economical and efficient in their construction and use, and provide a more secure and reliable engagement of the article to be monitored.

SUMMARY OF A PREFERRED EMBODIMENT

Accordingly, it is a general object of a preferred embodiment of the invention to overcome the disadvantages of the existing inventions in the field.

It is another objective of a preferred embodiment of the invention to provide a cost-efficient EAS tag.

It is another objective of a preferred embodiment of the invention to provide an EAS tag that is durable.

It is a further objective of a preferred embodiment of the invention to provide an EAS tag that is detachable when used with an authorized detaching unit.

It is a further objective of a preferred embodiment of the invention to provide an EAS tag that provides a tag that can be attached to an item to be monitored without penetrating the item.

It is still a further objective of a preferred embodiment of the invention to provide a theft deterrent device that can be quickly and easily secured to an article made of varying materials to prevent the unauthorized removal of the article.

It is yet a further object of a preferred embodiment of the invention to provide a rugged theft deterrent unit to permit the repeated use thereof.

In keeping with the principles of a preferred embodiment of the present invention, an EAS theft deterrent tag is disclosed wherein the tag is capable of engaging articles that are to be monitored without necessitating the puncture of the articles with a pin. In addition, by providing a first and second portion that are hingedly attached, labor time and costs are reduced when removing the tag from an article because separate bins are not required for the pin and the body. In addition, replacement costs are further reduced because the mate for the tag cannot be separated and lost.

Although a non-puncturing arrangement is described in one preferred embodiment, it is to be understood that the attaching mechanism may be substituted for others which are known in the art, e.g. pin clutch mechanism, arcuate probe detacher mechanism, etc.

Also, the engaging region of the tag is resiliently supported such that it adjusts to the width of the article to which it is attached.

Such stated objects and advantages of a preferred embodiment of the invention are only examples and should not be construed as limiting the present invention. These and other objects, features, aspects, and advantages of a preferred embodiment of the invention herein will become more apparent from the following detailed description of the embodiments of the invention when taken in conjunction with the accompanying drawings and the claims that follow.

BRIEF DESCRIPTION OF THE DRAWINGS

It is to be understood that the drawings are to be used for the purposes of illustration only and not as a definition of the limits of a preferred embodiment of the invention. In the drawings, wherein similar reference characters denote similar elements throughout the several views.

DETAILED DESCRIPTION OF A PREFERRED EMBODIMENT

Figure 1:
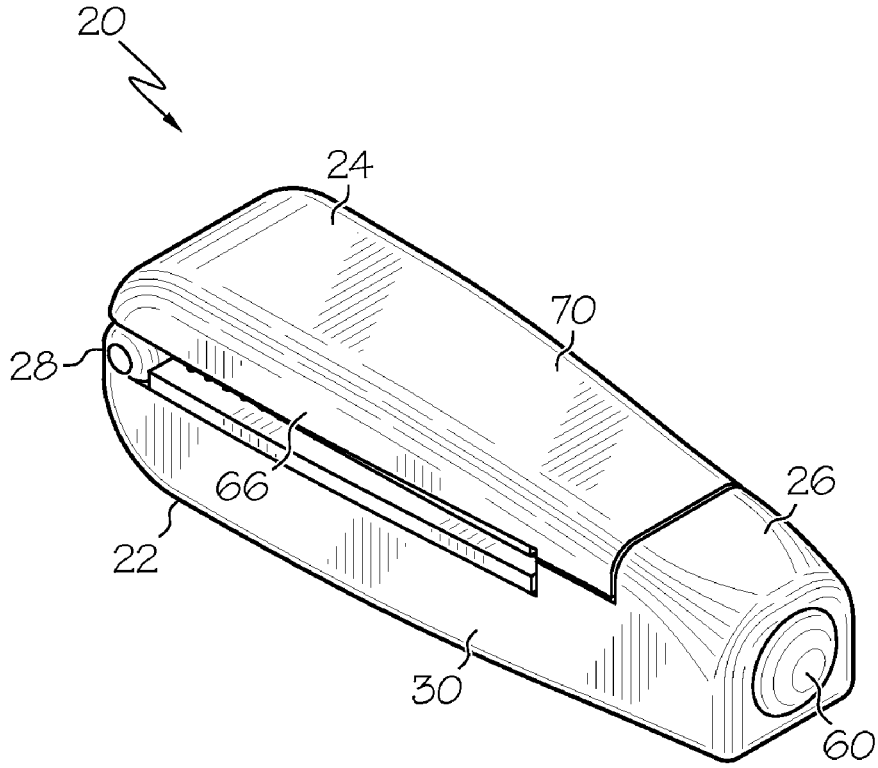
FIG. 1 is a front perspective view of the tag of the instant invention in an engaged state.

Referring now to a preferred embodiment illustrated in FIGS. 1 through 4, a tag 20 is illustrated having a first portion 22 and a second portion 24. First and second portions 22 and 24 are preferably made of a hard or rigid material and are adapted to attach to one another and form a front end 26 and a rear end 28. For purposes of illustration, but not limitation, a usable rigid or hard material might be a hard plastic such as an injection molded ABS plastic. First and second portions 22 and 24 are hingedly attached at rear end 28 and are detachably attached at the front end 26 by an attaching mechanism.

Now also referring to all of the figures, first portion 22 has first left wall 30 and a first right wall 32 interconnected at the periphery thereof by a first outer wall 34 and a first inner wall 36, thereby a first compartment 38 is formed therebetween. In a preferred embodiment, ABS plastic material is used to make tag 20 whereby first left and right walls 30 and 32 and first outer wall 34 may be injection molded and then first inner wall 36 is then joined with first outer wall 34 and first inner wall 36 via an ultrasonic weld, adhesive, or other appropriate joining means, or a combination thereof.

First portion 22 has a first compartment 38 defined therein which receives a marker 40 which is adapted to be used in Electronic Article Surveillance or adapted to be used as an RFID device. Marker 40 may be a resonant tag circuit which is not the subject of the instant invention. A detailed description, however, of a marker is disclosed in commonly owned U.S. Pat. No. 7,084,766, titled "Article Surveillance Tag Having a Metal Clip," which is incorporated herein by reference. It is to be understood that alternate resonant tag circuitry that is known in the art may also be used with the instant invention—e.g. AM or FM technologies. The marker 40 is not limited to the coiled embodiment depicted and may take the shape of the EAS marker depicted in U.S. Pat. No. 6,689,490, or any other marker known in the art. Marker 40 functions with electronic article surveillance systems that are well known in the art to prevent theft and similar unauthorized removal of articles from a controlled area. Also, an RFID marker may be used either in combination with the EAS system or substituted therefor.

A first partition 42 is positioned within first compartment 38 and substantially traverses between first left 30, first right 32, first outer 34, and first inner 36 walls. A second partition 44 of first compartment 38 substantially traverses first left 30, first right 32, and first outer 34 walls such that there is an opening 46 defined between first partition 42 and second partition 44. A second compartment 48 is formed on the opposite side of second partition 44. An aperture 50 extends through second partition 44.

Second compartment 48 houses an attaching member 52 and a resilient member 54. Attaching member 52 has a base 56 and an elongated region 58 extending therefrom. Attaching member 52 is adapted to be moveably received within second compartment 48 such that elongated region 58 extends through aperture 50 and into opening 46 and can be retracted therefrom. Resilient member 54 is positioned at the base 56 and presses against an enclosing wall 60. In one preferred embodiment, enclosing wall 60 has a peripheral wall 62 extending therefrom such that a bore 64 is created therein. The resilient member 54 is first inserted into the bore 64 followed by the base 56 such that elongated region 58 extends out of the bore 64 and is inserted into aperture 50. Resilient member 54 and attaching member 52 are moveably maintained within bore 64. Although a coiled spring is illustrated as comprising resilient member 54, it is to be understood that is only a preferred embodiment and other resilient materials may be used, such as rubber or elastics. It is also to be understood that the shock absorption teachings in application Ser. No. 11/255,428, may be incorporated herein.

In the preferred embodiment, the use of an elongated region 58 instead of a piercing pin reduces the liability arising out of workplace injuries. When retailer employees attempt to tag an item to be monitored with the preferred embodiment, they do not need to hold a tag and attempt to pierce the item with a pin, which may result in puncturing the skin or other work place injuries such as stepping on a loose pin. That being the stated, a pin and clutch mechanism may be substituted for elongated region 58 without departing from the essence of a preferred embodiment of the invention.

Second portion 24 has a second left wall 66 and a second right wall 68 interconnected at the periphery thereof by a second outer wall 70, thereby a space 72 is formed there between. Second portion 24 has a leading end 74 that is distal to rear end 28. An attaching component 76 extends from leading end 74 and attaching component 76 is adapted to engage attaching member 52 in a secure yet releasable manner. Attaching component 76 defines a cavity 78 which is adapted to receive elongated region 58 of attaching member 52 therein in a secure, yet removable, manner. In a preferred embodiment, attaching component 76 has a front edge 80 that is beveled and when attaching component 76 is inserted into opening 46, front edge 80 forces elongated region 58 towards enclosing wall 60. As attaching component 76 travels further into opening 46, cavity 78 becomes axially aligned with elongated region 58 and resilient member 54 forces elongated region 58 into cavity 78 and securely maintains attaching component 76 within opening 46.

A barrier 82 is resiliently maintained within space 72. In one preferred embodiment, a resilient device 84 is placed within space 72 and is attached to second outer wall 70. Resilient device 84 also attaches to barrier 82 and maintains barrier 82 in an adjustable manner. Resilient device 84 may be constructed of spring sheet metal in one preferred embodiment; however, it is to be understood that alternative materials having resilient qualities may be substituted therefor (e.g. coiled springs, elastic materials, or others known in the art). Resilient device 84 has a first arm 86 and a second arm 88 extending upwardly from opposing sides of an intermediate region 90. Intermediate region 90 has a void 92 therein. The different areas of contact between the first arm 86 and second arm 88 and barrier 82 defeats a miscreants attempt to press down a portion of a barrier because, in response, another portion of the barrier will be raised in response.

In one preferred embodiment, barrier 82 has a first surface 94 and a second surface 96, whereby resilient device 84 is received on first surface 94. A hole 98 is defined through barrier 82. A protrusion 100 extends inwardly from second outer wall 70 and travels through void 92 and in resilient device 84 and hole 98 of barrier 82. An engaging component 102 attaches to protrusion 100 and moveably maintains barrier 82 in space 72. In one preferred embodiment, engaging component 102 may be a threaded element, for example a screw. A substantially annular member 104 may be placed on a lip 106, which substantially annular member 104 makes contact with engaging component 102.

Figure 2:
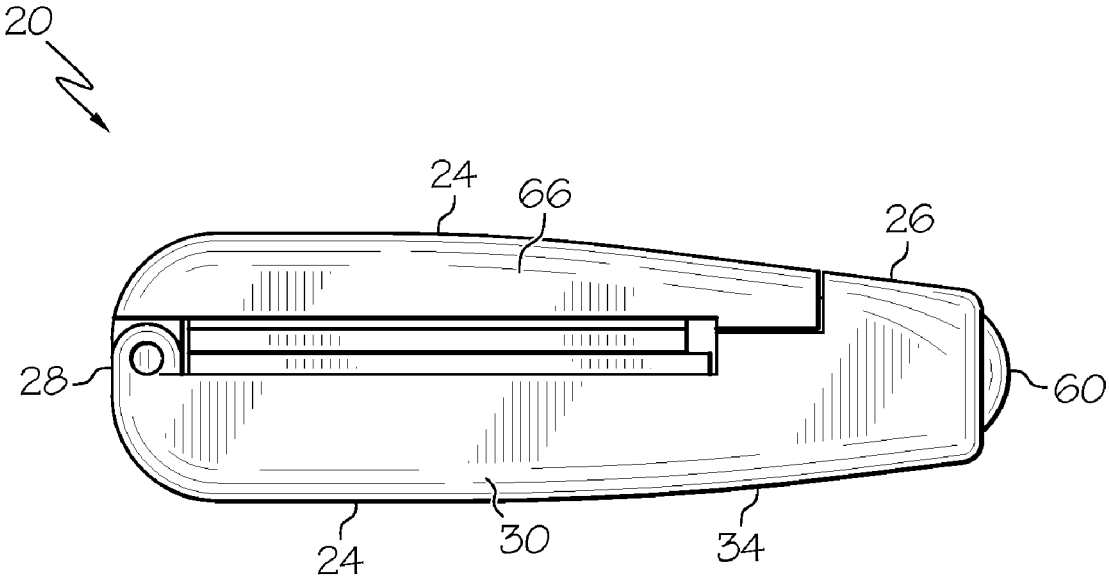
FIG. 2 is a side elevational view of the tag in an engaged state.

When tag 20 is in an attached position, as illustrated in FIGS. 1 and 2, the article to be monitored is firmly maintained between barrier 82 and first inner wall 36. When the article, for example a neck-tie or brassiere strap, is inserted between barrier 82 and first inner wall 36, the barrier 82 is dynamic and can adjust to engage and maintain articles of varying thickness. Second surface 96 may be textured, for example by at least one projection 108, to provide for a more firm article engagement. In addition, second surface 96 may also be ribbed such that part of the article is maintained between the ribs. First inner wall 36 may also be textured, for example by at least one projection 108, to further engage and maintain the article there between.

In order to allow the removal of tag 20 from an article maintained therein, a magnet having a predetermined amount of magnetic force for overcoming the force applied by first resilient member 54 on attaching member 52 is applied to enclosing wall 60. When the predetermined amount of magnetic force is applied, attaching member 52 is forced to move towards enclosing wall 60 by compressing resilient member 54 which thereby withdraws elongated region 58 from engagement with attaching component 76 and attaching component 76 can now be withdrawn from opening 46. Upon removal of the magnetic force, resilient member 54 recoils and forces elongated region 58 to its attaching state to receive attaching component 76. The magnets of sufficient force are not readily available to miscreants that would attempt to defeat the article surveillance provided by tag 20.

Figure 3:
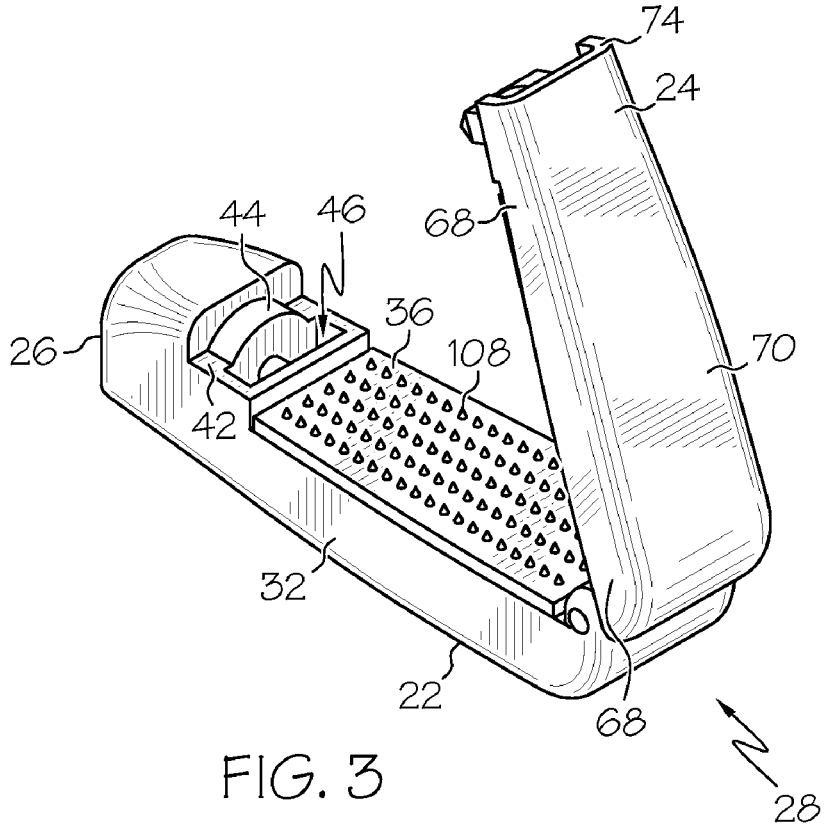
FIG. 3 is a rear perspective view of the tag in an unengaged state.
Figure 4:
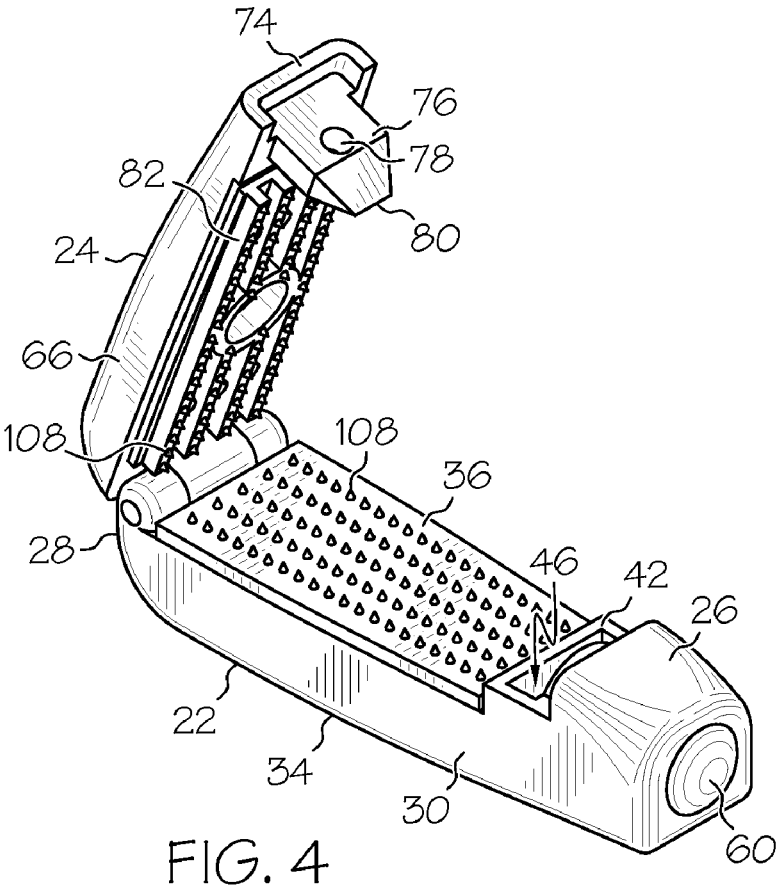
FIG. 4 is a left front perspective view of the tag in an unengaged state.
Figure 5:
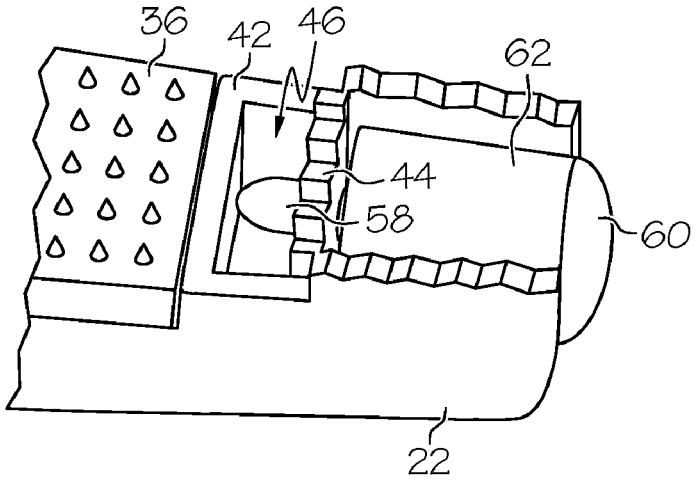
FIG. 5 is a partial cut-away perspective view of the front end of the tag.
Figure 6:
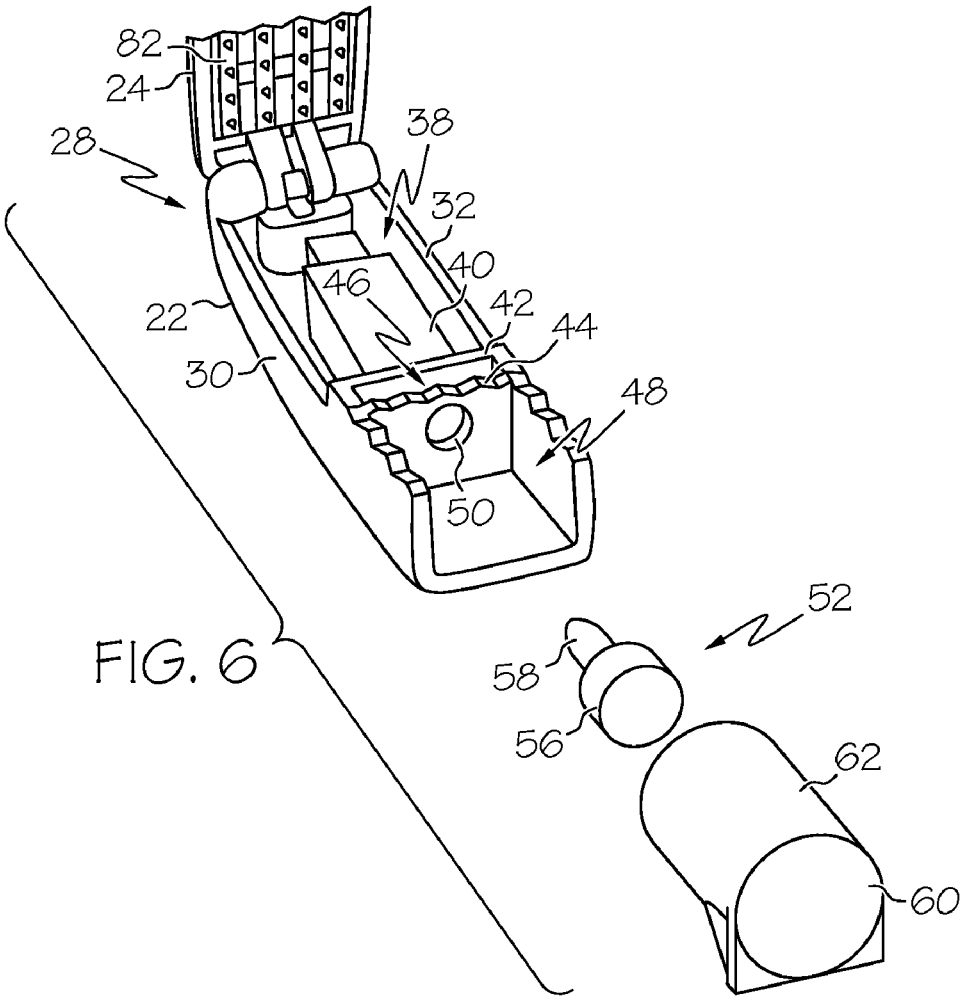
FIG. 6 is a partial cut-away exploded view of a first portion of the tag in an unassembled and unengaged state.
Figure 7:
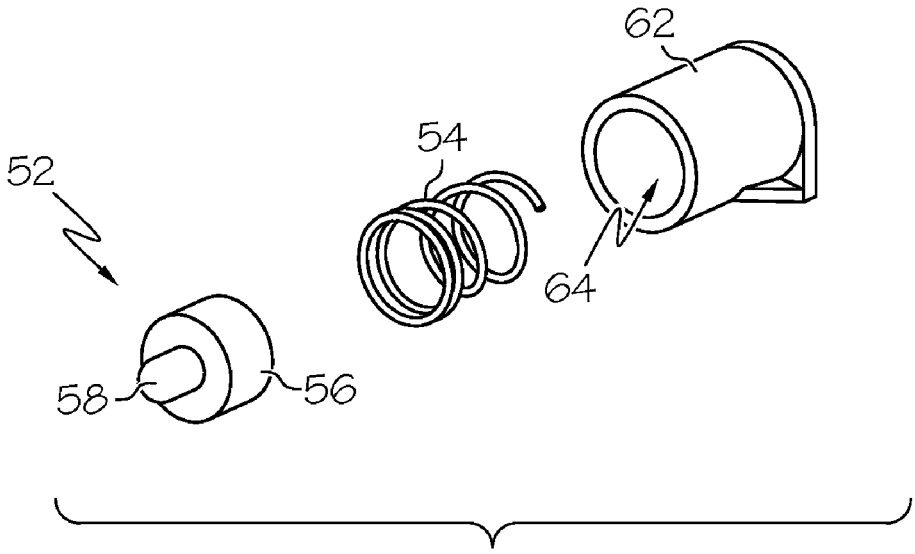
FIG. 7 is a perspective exploded view of attaching member, resilient member, and enclosing wall.
Figure 8:
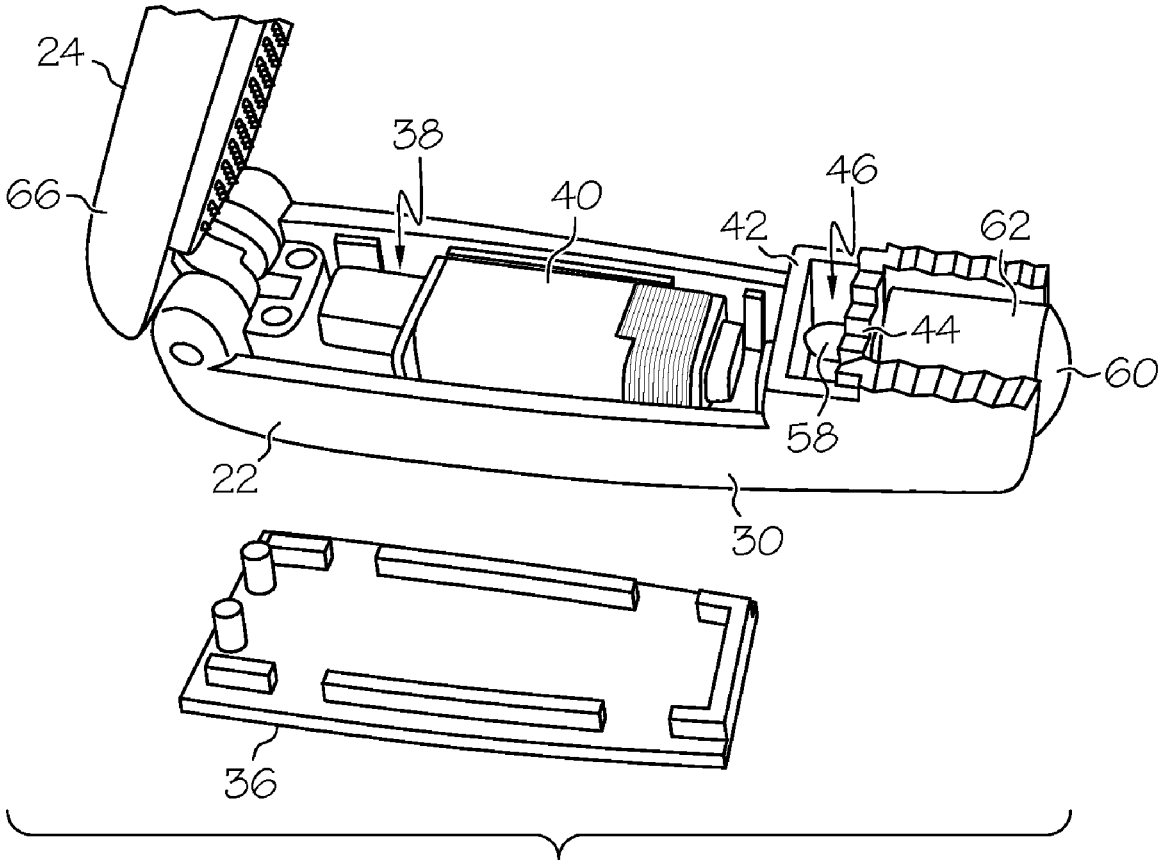
FIG. 8 is a partial cut-away side perspective view of first portion of the tag.
Figure 9:
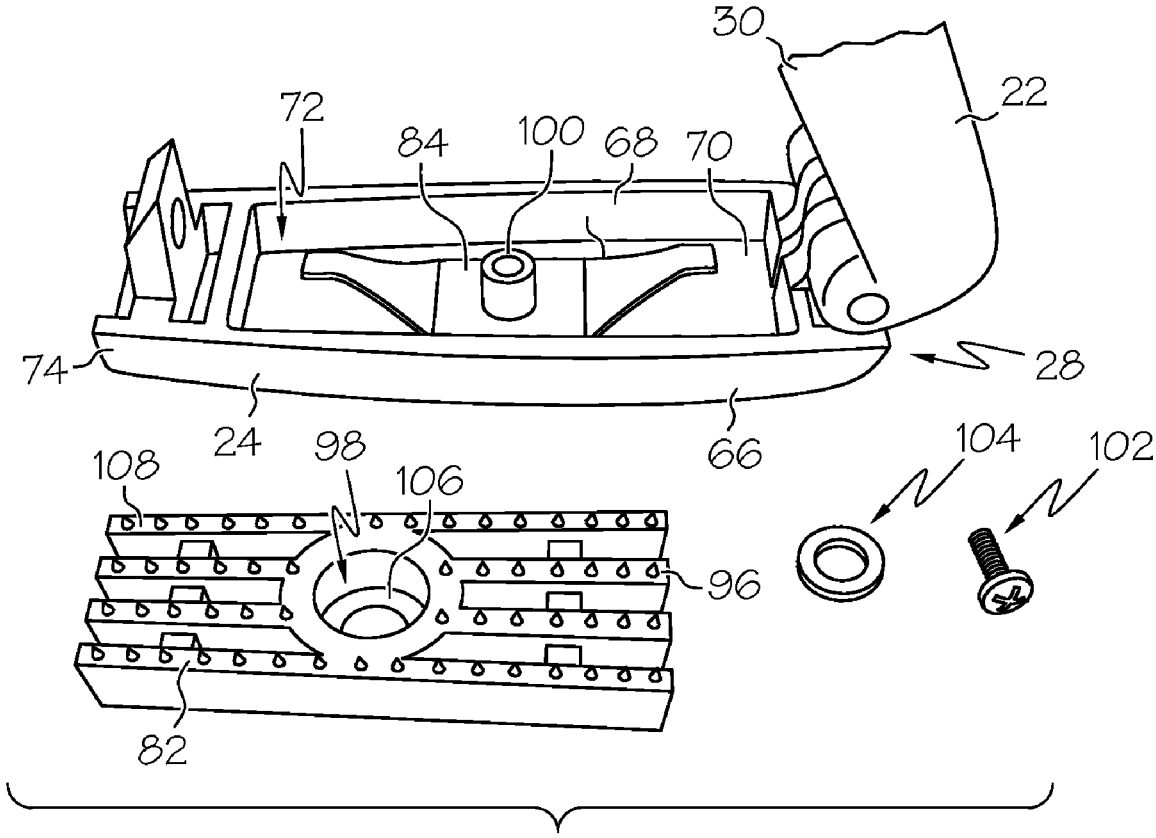
FIG. 9 is a perspective exploded view of the second portion of the tag.
Figure 10:
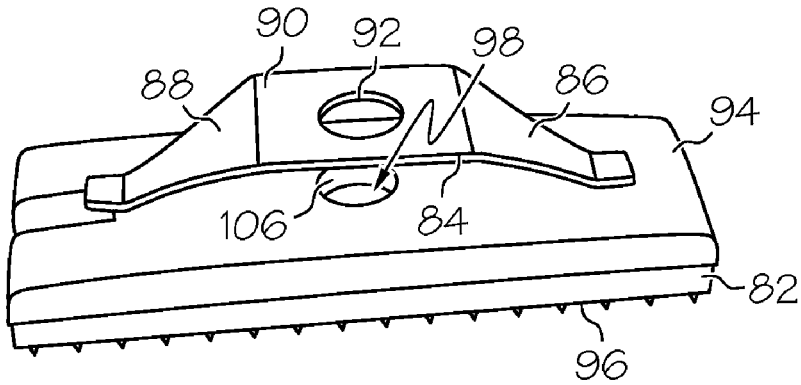
FIG. 10 is a side perspective view of the barrier and resilient device.

In a preferred embodiment, a biasing element (not shown) is installed in rear end 28 and functions with the hinged attachment thereof to maintain tag 20 in a normally unattached state as illustrated in FIGS. 3 and 4. Accordingly, when a magnetic force is applied to enclosing wall 60 causing withdrawal of elongated region 58 from attaching component 76, tag 20 assumes the unattached state as a result of biasing element. In a preferred embodiment, biasing element is a coiled member with elongated arms whereby one arm is received in first portion 22 and another arm is received in second portion 24.

While the above description contains many specificities, these should not be construed as limitations on the scope of the invention, but rather as an exemplification of one preferred embodiment thereof. Many other variations are possible without departing from the essential spirit of this invention. Accordingly, the scope of the invention should be determined not by the embodiment illustrated, but by the appended claims and their legal equivalents.

What is claimed is:

1. An article surveillance device, comprising:

a first portion and a second portion that are movably attached to one another at a rear end;

a marker;

an attaching mechanism attaching said first portion to said second portion at a front end;

a barrier resiliently maintained within said second portion such that it engages an article to be monitored in a secure, yet removable, manner between the first portion and the second portion; said second portion comprising a second outer wall having a second left wall and a second right wall extending inwardly therefrom to form a space therein;

a resilient device attaching to said second outer wall and supporting said barrier in a height adjustable manner.

2. The device of claim 1, wherein the article maintained between the first portion and the second portion is not pierced.

3. The device of claim 1, wherein the barrier is made of a rigid material.

4. The device of claim 1, wherein the barrier is made of an inflexible material.

5. The device of claim 1, wherein the barrier is made of ABS plastic.

6. The device of claim 1, wherein at least one projection extends from the barrier and engages the article.

7. The device of claim 1, wherein at least one projection extends from the barrier and contacts and maintains the article in between the first portion and second portion.

8. The device of claim 1, wherein the resilient device maintains said barrier at a height above the second left and right walls.

9. The device of claim 1, wherein the resilient device maintains said barrier at an adjustable height in relation to the article's thickness.

10. The device of claim 1, wherein the first and second portions are hingedly attached at the rear end.

11. An electronic article surveillance device, comprising;

a marker;

a first portion and a second portion that are movably attached to one another at a rear end;

an attaching mechanism attaching said first portion to said second portion at a front end;

a first inner wall defined on the first portion that faces the second portion;

a second outer wall of said second portion having a second left wall and a second right wall extending inwardly from the second outer wall and forming a space therein;

a resilient device attaching to said second outer wall;

a barrier supported on the resilient device in a height adjustable manner;

an article that is to be monitored is engaged between the first inner wall and the barrier in a secure, yet removable, manner.

12. The device of claim 11, wherein the resilient device determines the height at which the barrier is held depending on the article's width.

13. The device of claim 11, wherein the first inner wall and the barrier are textured in order to more securely maintain the article therein.

14. The device of claim 11, wherein the article's width is larger, a greater portion of the barrier will retreat into the space of second portion.

15. The device of claim 11, wherein the barrier is maintained at a greater height than said second left and right walls.

16. The device of claim 11, wherein the second section further comprises:

a protrusion extending from said second outer wall;

a hole defined in said barrier and adapted to receive the protrusion therein;

an engaging component received in said protrusion such that said barrier is maintained within said space in a height adjustable manner.

17. The device of claim 16, wherein a substantially annular member rests between the engaging component and the protrusion.

18. The device of claim 11, wherein the resilient device is a spring sheet metal having a first arm and a second arm extending outwardly from an intermediate region in opposing directions and the first and second arms supporting said barrier.

19. The device of claim 18, wherein a void is defined in the intermediate region of the resilient device such that said protrusion extends therethrough.

20. A theft deterrent tag, comprising:

a first portion and a second portion that are movably attached to one another at a rear end;

an attaching mechanism attaching said first portion to said second portion at a front end;

a barrier resiliently maintained within said second portion such that it engages an article to be monitored in a secure, yet removable, manner between the first portion and the second portion; said second portion comprising a second outer wall having a second left wall and a second right wall extending inwardly therefrom to form a space therein;

a resilient device attaching to said second outer wall and supporting said barrier in a height adjustable manner.

* * * * *